US007393421B2

(12) United States Patent
Yang

(10) Patent No.: US 7,393,421 B2
(45) Date of Patent: Jul. 1, 2008

(54) METHOD FOR IN-DIE SHAPING AND QUENCHING OF MARTENSITIC TUBULAR BODY

(75) Inventor: Wuhua Yang, Ann Arbor, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 270 days.

(21) Appl. No.: 11/400,843

(22) Filed: Apr. 10, 2006

(65) Prior Publication Data

US 2007/0235111 A1 Oct. 11, 2007

(51) Int. Cl.
*C21D 8/10* (2006.01)

(52) U.S. Cl. ..... 148/570; 148/575; 148/593

(58) Field of Classification Search ..... 148/570, 148/575, 593

See application file for complete search history.

(56) References Cited

U.S. PATENT DOCUMENTS

| | | | |
|---|---|---|---|
| 4,584,860 | A | 4/1986 | Leonard |
| 5,410,132 | A | 4/1995 | Gregg et al. |
| 5,630,322 | A | 5/1997 | Heilmann et al. |
| 5,960,658 | A | 10/1999 | Hudson et al. |
| 5,992,197 | A | 11/1999 | Freeman et al. |
| 6,067,831 | A | 5/2000 | Amborn et al. |
| 6,322,645 | B1 | 11/2001 | Dykstra et al. |
| 6,613,164 | B2 | 9/2003 | Dykstra et al. |
| 6,862,910 | B2 | 3/2005 | Amborn |
| 6,921,444 | B2 | 7/2005 | Joaquin et al. |
| 2003/0197295 | A1 | 10/2003 | Nakai et al. |

*Primary Examiner*—George Wyszomierski

(57) ABSTRACT

A process that combines tubular body pressure induced shaping at elevated temperatures with a controlled rapid quenching operation using a gaseous quenching medium in a common unit. The achievable cooling rate permits the in-die shaping and quenching of tubular structural components of martensitic steels without requiring the use of a separate discrete quenching.

12 Claims, 2 Drawing Sheets

METHOD FOR IN-DIE SHAPING AND QUENCHING OF MARTENSITIC TUBULAR BODY

TECHNICAL FIELD

The present invention relates generally to the field of structural metal body fabrication and heat treatment and more particularly to methods for gas induced formation and quenching of heat treatable steel tubular body structures to achieve desired shape and compositional characteristic with the formation and retention of substantial percentages of martensite within the final part.

BACKGROUND OF THE INVENTION

Tubular structural components for use in applications such as automotive production, aircraft manufacture and the like are generally known. Currently, such tubular structural components are often shaped using a hydroforming process operated at room temperature. Such hydroforming processes have found particular application in the fabrication of structural components made from lightweight alloys and mild steels. Shaping of advanced high strength steels (AHSS) such as martensitic steels has typically utilized an initial thermal forming process followed by separate quenching by a liquid phase quench solution and annealing treatments applied to achieve the desired martensitic steel microstructure. Although the use of such discrete thermal forming and quench treatments has been used successfully, such practices are relatively complex and may require substantial skill to avoid variation and distortion in the final product.

SUMMARY OF THE INVENTION

The present invention provides advantages and alternatives over the prior art by providing a process that successfully combines tubular body shaping at elevated temperatures with a controlled rapid quenching operation using a gaseous quenching medium in a common unit so as to improve efficiency while simultaneously providing improved control of the quenching parameters. The achievable cooling rate permits the in-die shaping and quenching of tubular structural components of martensitic steels without requiring the use of a separate discrete quenching unit.

According to one potentially preferred aspect, a process is provided wherein a tubular member of heat treatable steel is formed to a desired shape in a heated mold cavity by application of internal pressure using a gaseous fluid. Following the development of a desired shape, the structure is thereafter subjected to a rapid introduction of cooling gas while being held within the mold. The cooling gas is delivered at a rate and temperature such that the steel alloy undergoes at least a partial martensitic transformation. The cooling gas may be held at an elevated pressure during the quenching process to promote heat transfer. Thereafter, heat may be reintroduced to the mold cavity to provide any desired tempering. Accordingly, a substantially simplified and streamlined process is provided for the formation and heat treatment of tubular martensitic steel structures.

BRIEF DESCRIPTION OF THE DRAWINGS

The present invention will now be described by way of example only, with reference to the accompanying drawings which constitute a part of the specification herein and, together with the general description above and the detailed description set forth below serve to explain concepts of the invention wherein.

While embodiments and practices according to the invention have been illustrated and generally described above and will hereinafter be described in connection with certain potentially preferred procedures and practices, it is to be understood that in no event is the invention to be limited to such illustrated and described embodiments procedures and practices. On the contrary, it is intended that the present invention shall extend to all alternatives and modifications as may embrace the principles of this invention within the true spirit and scope thereof.

DESCRIPTION OF PREFERRED EMBODIMENTS

Figure 1:
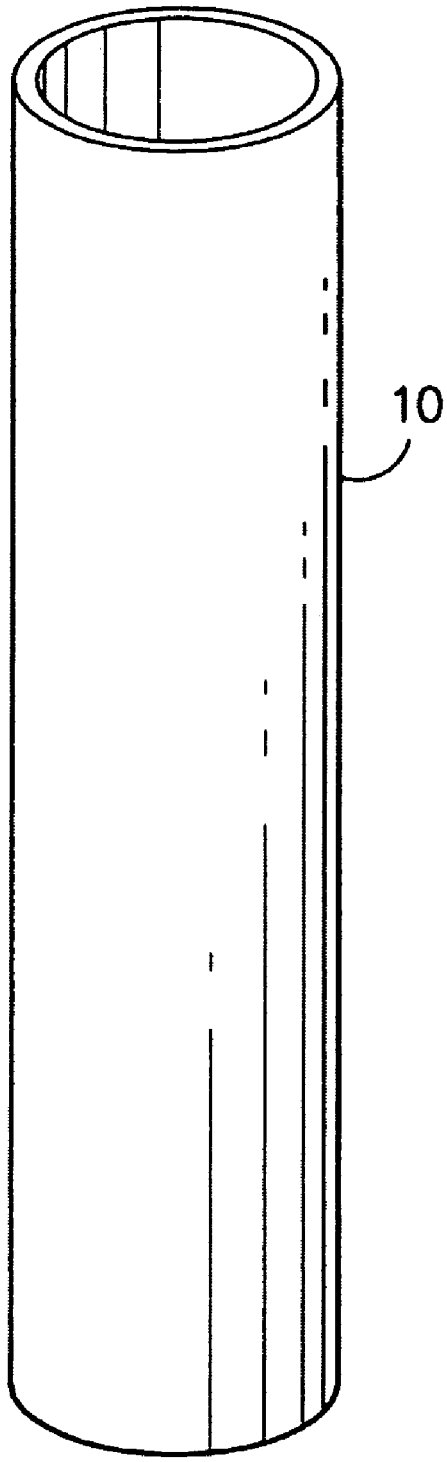
FIG. 1 illustrates a metallic tubular blank.

Reference will now be made to the drawings, wherein like reference numerals are utilized to designate like components in the various views. In FIG. 1, a tubular blank 10 of a heat treatable steel alloy is illustrated. As will be appreciated, the heat treatable steel alloy undergoes at least partial transformation from austenite to martensite when the alloy is heated and then rapidly cooled. Specifically, when the heated alloy is cooled at a rate above a critical level, equilibrium changes are suppressed and the austenite fcc lattice structure present at the elevated temperature changes rapidly to a martensite body-centered tetragonal microstructure. Such maternsitic materials have substantially improved strength characteristics relative to a corresponding non-heat quenched material that cools under equilibrium conditions.

Figure 2:
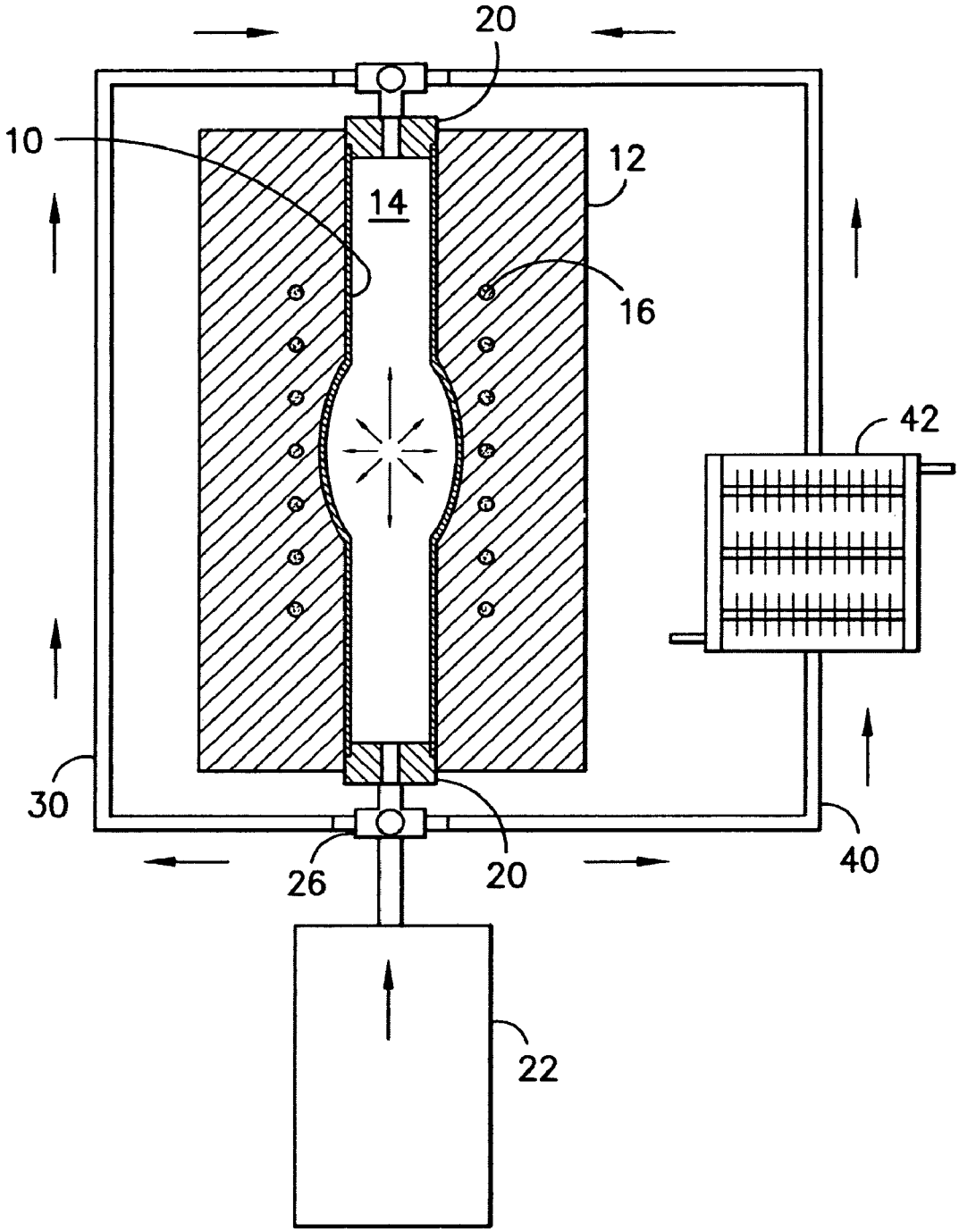
FIG. 2 illustrates schematically a system for the gas pressure shaping and quenching of the tubular blank in FIG. 1.

A system of thermal shaping and quenching a steel alloy tubular blank 10 to achieve martensitic transformation is illustrated schematically in FIG. 2. As shown, the system includes a heated mold 12 of ceramic, graphite or the like incorporating a heated and insulated interior cavity 14. The cavity 14 is sized to accommodate the tubular blank 10 and may be shaped to correspond to the final desired shape of the structure formed from the tubular blank 10 after pressure induced thermal shaping as will be described further hereinafter.

By way of example only, and not limitation, it is contemplated that the mold 12 may be in the form of a ceramic die incorporating an embedded induction coil 16 or other heating element as may be desired. The heat applied by the induction coil 16 or other heating element causes the temperature of the tubular blank to be raised above its softening point and into the austenitic phase such that the blank 10 may be pressurized at its interior and shaped into conformance with the contours of the cavity 14. In order to facilitate this pressure induced molding, the cavity 14 is preferably sealed at both ends by seals 20. In this regard, the seals 20 at either end of the cavity 14 are preferably provided with controlled gas flow openings to permit the introduction and withdrawal of gas at rates as may be desired.

As illustrated, it is contemplated that the system may utilize a singular gas supply 22 of a substantially non-reactive gaseous fluid such as helium, argon or nitrogen. It is contemplated that the gaseous fluid may be stored in either a gaseous or liquid state although a liquid state may be preferred for large volume requirements. The gas supply 22 may be operatively connected to a control valve 26 to permit the flow of gas into the system. In practice, the control valve 26 may be operated either manually or remotely to direct gas flow from the gas supply and into the mold cavity 14 along a predefined circuit.

As previously indicated, pressurizing gas from the gas supply 22 may be transported into the heated cavity 14 so as to occupy space at the interior of the tubular blank 10. During this pressurizing step the control valve 26 is adjusted to transmit pressurizing gas through a first supply leg 30 so as to build pressure at the interior of the heated and softened tubular blank 10. Under this pressurized condition, the tubular blank 10 is caused to expand outwardly and substantially conform to the contours of the cavity 14 as illustrated. As will be appreciated, the introduction of pressurizing gas during this shaping process is preferably carried out at a relatively low volumetric flow rate while maintaining the cavity in a substantially plugged condition with the tubular blank 10 held at a temperature above its softening temperature. Thus, relatively little thermal energy is transmitted to the gas during the shaping process.

Once the tubular blank 10 has been shaped to the desired profile, it is contemplated that the gas supply 22 previously used for shaping may thereafter be used to provide a gaseous quenching medium to effect a rapid quench of the heated and shaped tubular blank 10 such that a martensitic reaction is introduced within the alloy forming the tubular blank 10. According to the illustrated practice, the quenching of the tubular blank 10 may be commenced by adjusting the control valve 26 so as to direct flow from the gas supply 22 and through a second supply leg 40. Unlike the pressure shaping step, during the quenching operation the inlet and outlet to the cavity 14 are set to allow some degree of flow of quenching gas through the cavity and across the interior surface of the tubular blank 10.

According to one contemplated practice, the flow rate through the tubular blank may be set so as to maintain a positive pressure of quenching gas at the interior of the tubular blank during at least a portion of the quenching process. Such higher pressures improve heat transfer characteristics. In practice it is contemplated that such gas pressure may be established at levels up to about 20 bar or more during the quenching step although the actual level will depend on factors such as the material forming the tubular blank, the dimensions of the part being formed and the desired final microstructure.

As shown, the second supply leg 40 may include an in-line heat exchanger of chilling unit 42 used to substantially cool the gas before it is introduced into the cavity 14. By way of example only, for nitrogen the temperature is preferably reduced to about 15 degrees C. prior to introduction into the cavity although higher or lower temperatures may be used if desired. As will be appreciated, by recirculation of the quenching gas through the mold cavity 14 and across the heat exchanger 42, a substantial rate of quenching may be achieved while avoiding the use of excessive volumes of gas.

Importantly, it has been found that the introduction of the low temperature gas into the mold cavity such that it flows across the interior surface of the shaped tubular member provides sufficient heat transfer to establish formation of martensite within the previously heated and formed tubular blank despite the fact that the exterior surface is held in contacting relation with mold walls. This is particularly true when the quenching gas is maintained under pressure. In this regard, it has been found that by adjusting the flow rate and temperature of the quenching gas that cooling rates sufficient to establish martensitic transformation can be achieved even with relatively thick walled structures. In fact, cooling rates approaching the critical cooling rate for formation of a fully martensitic structure may be approached.

It is to be understood that while the present invention has been illustrated and described in relation to potentially preferred embodiments, constructions, and procedures, that such embodiments, constructions, and procedures are illustrative only and that the present invention is in no event to be limited thereto. Rather, it is contemplated that modifications and variations embodying the principles of the present invention will no doubt occur to those of skill in the art.

The invention claimed is:

1. A process for thermal forming and quenching a tubular structure of heat treatable steel alloy to produce a molded structure characterized by a martensitic phase structure, the process comprising:

(a) introducing a tubular member of heat treatable steel alloy into a shape-defining mold cavity;

(b) heating the tubular member to a level above its softening point such that the steel alloy assumes a substantially austenitic phase structure;

(c) molding the heated tubular member by introducing a molding gaseous fluid into the mold cavity wherein the molding gaseous fluid applies gas pressure against portions of the tubular member at the interior of the tubular member such that the tubular member is pushed outwardly to assume a shape substantially conforming with the mold cavity; and (d) quenching the molded tubular member to at least partially transform the austenitic phase structure to a martensitic phase structure by flowing a quenching gaseous fluid through the interior of the molded tubular member while the tubular member is held within the mold cavity with exterior surface portions of the molded tubular member held in contacting relation with the surface of the mold cavity.

2. The invention as recited in claim 1, wherein the mold cavity is induction heated.

3. The invention as recited in claim 1, wherein the quenching gaseous fluid is cooled prior to contacting the tubular member.

4. The invention as recited in claim 3, wherein during the quenching step the quenching gaseous fluid is recirculated through the tubular member and a cooling unit.

5. The invention as recited in claim 1, wherein the molding gaseous fluid and the quenching gaseous fluid are each selected from the group consisting of helium, nitrogen and argon.

6. The invention as recited in claim 5, wherein the molding gaseous fluid and the quenching gaseous fluid are the same gas supplied from a common supply source.

7. The invention as recited in claim 1, further comprising the step of reheating the molded tubular member to an annealing temperature after the quenching step while the tubular member is held within the mold cavity with exterior surface portions of the molded tubular member held in contacting relation with the surface of the mold cavity.

8. A process for thermal forming and quenching a tubular structure of heat treatable steel alloy to produce a molded structure characterized by a martensitic phase structure, the process comprising:

(a) introducing a tubular member of heat treatable steel alloy into a shape-defining mold cavity;

(b) heating the tubular member to a level above its softening point such that the heat treatable steel alloy assumes a substantially austenitic phase structure;

(c) molding the heated tubular member by introducing a molding gaseous fluid into the mold cavity wherein the molding gaseous fluid applies gas pressure against portions of the tubular member at the interior of the tubular member such that the tubular member is pushed outwardly to assume a shape substantially conforming with the mold cavity, wherein the molding gaseous fluid is selected from the group consisting of helium, nitrogen and argon;

(d) quenching the molded tubular member to at least partially transform the austenitic phase structure to a martensitic phase structure by flowing a quenching gaseous fluid selected from the group consisting of helium, nitrogen and argon through the interior of the molded tubular member while the tubular member is held within the mold cavity with exterior surface portions of the molded tubular member held in contacting relation with the surface of the mold cavity and wherein the quenching gaseous fluid is maintained at a positive pressure at the interior of the molded tubular member as it flows through the molded tubular member.

9. The invention as recited in claim 8, wherein the mold cavity is induction heated.

10. The invention as recited in claim 8, wherein the molding gaseous fluid and the quenching gaseous fluid are the same gas supplied from a common supply source.

11. The invention as recited in claim 8, wherein during the quenching step the quenching gaseous fluid is recirculated through the tubular member and a cooling unit.

12. A process for thermal forming and quenching a tubular structure of heat treatable steel alloy to produce a molded structure characterized by a martensitic phase structure, the process comprising:

(a) introducing a tubular member of heat treatable steel alloy into a shape-defining mold cavity;

(b) heating the tubular member to a level above its softening point such that the heat treatable steel alloy assumes a substantially austenitic phase structure;

(c) molding the heated tubular member by introducing a molding gaseous fluid into the mold cavity wherein the molding gaseous fluid applies gas pressure against portions of the tubular member at the interior of the tubular member such that the tubular member is pushed outwardly to assume a shape substantially conforming with the mold cavity, wherein the molding gaseous fluid is selected from the group consisting of helium, nitrogen and argon;

(d) quenching the molded tubular member to at least partially transform the austenitic phase structure to a martensitic phase structure by flowing a quenching gaseous fluid selected from the group consisting of helium, nitrogen and argon through the interior of the molded tubular member while the tubular member is held within the mold cavity with exterior surface portions of the molded tubular member held in contacting relation with the surface of the mold cavity and wherein the quenching gaseous fluid is maintained at a positive pressure at the interior of the molded tubular member as it flows through the molded tubular member; and (e) reheating the molded tubular member to an annealing temperature after the quenching step while the tubular member is held within the mold cavity with exterior surface portions of the molded tubular member held in contacting relation with the surface of the mold cavity.

* * * * *